United States Patent [19]

Chien-Tung

[11] 4,330,167

[45] May 18, 1982

[54] FUSED ELECTRIC PLUG

[76] Inventor: Chen Chien-Tung, 7, Lane 1230, Kuang Fu Rd., Hsin Chu City, Taiwan

[21] Appl. No.: 104,815

[22] Filed: Dec. 18, 1979

[51] Int. Cl.[3] ..... H01R 13/68

[52] U.S. Cl. ..... 339/147 P; 337/198; 339/196 R

[58] Field of Search ..... 337/197–198; 339/157 C, 195, 196, 206 P, 217 PS, 147

[56] References Cited

U.S. PATENT DOCUMENTS

| | | | |
|---|---|---|---|
| 3,482,204 | 12/1969 | Grunbaum | 339/196 R |
| 3,798,582 | 3/1974 | Schwartz | 339/197 |
| 4,073,564 | 2/1978 | Davis, Jr. | 339/157 C |
| 4,080,039 | 3/1978 | Ahroni | 337/198 |
| 4,176,902 | 12/1979 | Bernstein | 339/147 P |
| 4,196,409 | 4/1980 | Juba | 337/198 |

*Primary Examiner*—John McQuade

*Attorney, Agent, or Firm*—Shoemaker and Mattare, Ltd.

[57] ABSTRACT

A fused electric plug is consisted of a unique housing assembly, two unique fuse elements and an upper cover. Two unique copper plates having three leg elements are mounted respectively in the housing assembly, and the fuse elements are put on the housing directly. The upper cover is fixed to the housing assembly by a fastener or high-frequency welding or any other appropriate manner, the two fuse elements are thus connected tightly between power source and load respectively.

11 Claims, 5 Drawing Figures

FUSED ELECTRIC PLUG

BACKGROUND OF THE INVENTION

1. Field of the Invention

The present invention relates to a novel structure of a fused electric plug, and, more particularly, to a fused electric plug which is constituted by a unique housing assembly and two unique fuse elements as well as an upper cover.

2. Description of the Prior Art

Different structures have been designed for a fused electric plug, especially for the plug adapted to a decoration string set. However, ordinary fused plugs are of complicated structure. Mass production of them is difficult and causes a waste of time and labor. Therefore, the cost of production is rather high. Furthermore, traditional forms of copper plate and fuses are used in the known plugs, no significant change has occurred, therefore, the conventional fused plug is only a rearrangement of the traditional copper plates, fuses and plug body.

SUMMARY OF THE INVENTION

It is an object of the present invention to provide a novel fused electric plug having two unique copper plates. Each plate has a three leg element configuration, the plate is formed by blanking from a single copper sheet. The first leg element of the copper plate is extended outside the plug body as prongs for connection power source, the other two leg elements of the copper plate are U-like in structure for receiving prongs of another plug.

It is another object of the present invention to provide a fused electric plug with two fuse elements with unique structure. Each fuse element includes two thin conductive filaments which are fixed and separated from each other by a small insulative ball between them. The two conductive filaments on one side of the ball are used for connection to power source, while, that on the other side of the ball connects to a fuse.

It is a further object of the present invention to provide a fused electric plug having a unique housing assembly, the housing assembly is formed with two holders for accommodating the two fuse elements. After the upper cover is fixed to the housing by means of fasteners or high-frequency welding or any other appropriate manner, the fuse elements are pressed and connected to the copper plates and two conductive terminals respectively for current conducting.

Other features and advantages of the present invention will be more apparent from the following description taken in connection with the accompanying drawing wherein:

DETAILED DESCRIPTION OF THE PREFERRED EMBODIMENTS

Figure 1:
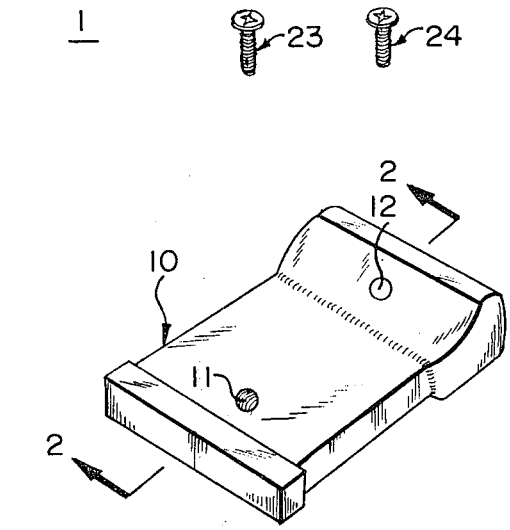
FIG. 1 is a perspective view of a first embodiment according to the invention, all elements being separated and placed in order to illustrate them clearly.
Figure 2:
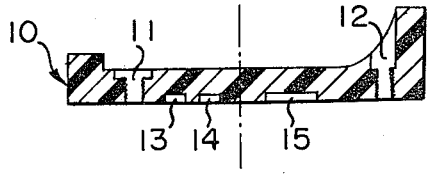
FIG. 2 is a sectional view of the upper cover according to the invention, which is taken along line 2—2 of FIG. 1.

Referring now to FIG. 1, which is the first embodiment of the present invention, the fused electric plug 1 is composed of an upper cover 10, two fuse elements 21 and 22, and a housing assembly 30. The upper cover 10 and the housing body 30 are made of insulating materials such as plastics and the like, and, the upper cover 10 and the housing assembly 30 can be fixed together by means of at least two fastener means 23 and 24, or high-frequency welding, or any other appropriate manner. The drawing shows two fasteners 23, 24 as a representative manner of fixing. The fasteners 23 and 24 can be passed through the holes 11 and 12 provided at the upper cover 10. As shown in FIG. 2, a plurality of cavities 13, 14 and 15 are formed on the bottom of the upper cover 10, the function of them will be discussed hereinafter. Each of the fuse elements 21 (or 22) has two thin conductive filaments which are fixed together by an insulative ball 27 (or 28) between them. Thus, one side of the insulative ball 27 (or 28) has two conductive portions 211 and 212 (or 221 and 222), while the other side of the ball 27 (or 28) has the other two conductive portions 211A and 212B (or 221A and 222B). Obviously, the conductive portions 211, 212 (222) are integrally connected to the other conductive portions 211A, 212B (or 221A, 222B). Two fuse filaments 311, 321 are jointed between the said two portions 221A-212B and 221A-222B on the other side of the balls 27, 28 respectively.

Figure 4:
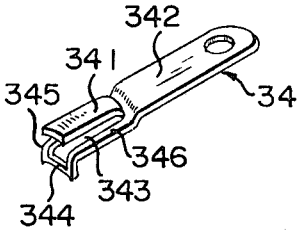
FIG. 4 is a perspective view of one copper plate as used in the first embodiment.

There are two slot openings 33A and 33B formed at the rear end of the body of the housing 30. Two copper plates 34A, 34B are mounted respectively to the housing 30 and in parallel direction each other. The structure of the copper plate is shown in FIG. 4 for details. The copper plate 34 is made from a single metal sheet at the proper distance from the longitudinal axis of the plate, it is blanked out for forming a first leg element 341 which is projecting outside the plate body, then a second leg element 345 and a third leg element 346 remain in the plate body. Between the second and third leg elements 345 and 346, there is a space 343 which is formed after the pressing of the first leg element 341, the end 344 is a common end for legs 345 and 346, of course, the legs 345, 346 may be separated from each other. The copper plate 34, without being pressed, is a flat planar portion such as portion 342. According to this structure, the aforementioned plates 34A and 34B have flat portions 342A and 342B extending outside the housing 30 as prongs respectively, while the leg elements 341, 345 and 346 are placed in the housing 30. Curved ends 345A and 344B are stopped by two cavities 35 and 36 formed in the housing 30 respectively. The second and third legs are formed in a chuck configuration which aligns with the said slot openings 33A and 33B. Therefore, prongs of another plug can be inserted therein for serial connection.

Figure 3:
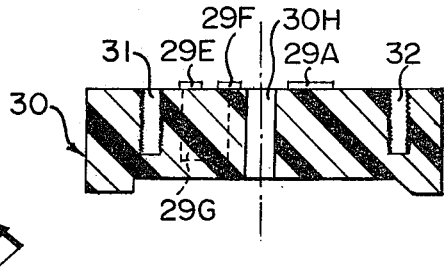
FIG. 3 is a sectional view of the housing body according to the invention, which is taken along line 3—3 of FIG. 1.
Figure 3:
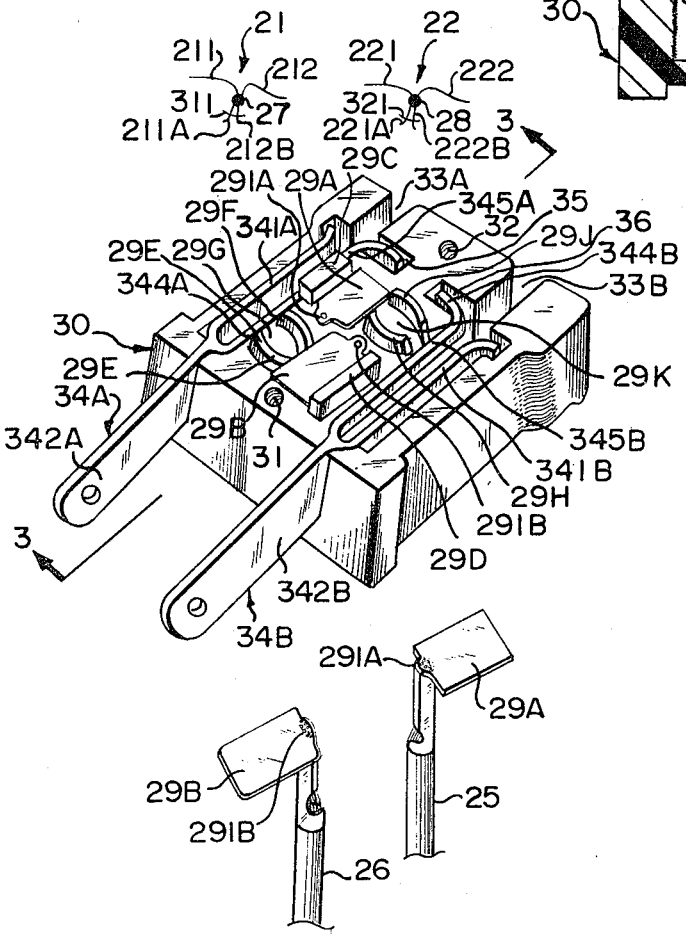

On the upper side of the housing 30, there are vertical insulating portions 29C and 29D. Near the second leg elements 345A, 345B of the plates 34A, 34B, there are two pairs of vertical walls 29E–29F and 29H–29J, then, spaces 29G and 29K are formed between each pair of vertical walls. Two conductive terminals 29A and 29B are placed between the second legs 345A, 345B and the said insulating portions 29C and 29D respectively. The conductive terminals 29A and 29B are of traditional structure, two conductors 291A, 291B of two PVC wires 25, 26 are connected respectively by the two terminals 29A, 29B. The two terminals 29A and 29B are inserted into the housing 30 through a hole 30H (as shown in FIG. 3) from the bottom side of the housing 30. Therefore, the insulating portions 29C and 29D are provided for insulating the terminals 29A and 29B from the second legs 345A and 345B of the copper plate 34A, 34B respectively.

Two holes 31 and 32, formed with threads, are perforated through the housing 30 symmetrically, the locations of which are relative to the holes 11 and 12 at the upper cover 10 for installation of fasteners 23 and 24. The holes 11, 12 31 and 32 can be omitted if high-frequency welding techniques are used for fixing the upper cover 10 to the housing assembly 30.

During assembly, the terminals 29A and 29B are placed near the insulating portions 29C and 29D respectively, the two conductive filaments 211, 212; 221 and 222 on one side of the fuse elements 21 and 22 are contacted to the second legs 345A, 345B and terminals 29B, 29A respectively. Thus, the fuse filaments 311, 321 together with the other two conductive filaments 211A–211B; 221A–221B on the other side of the fuse elements 21, 22 are housed within the spaces 29G and 29K respectively. It can be seen that the fuse elements 21, 22 are then connected between the power source (that is, plates 34A, 34B) and the load (that is, PVC wires 25, 26 connected to the terminals 29A, 29B) respectively.

Once the upper cover 10 is fixed to the housing 30, the fuse elements 21 and 22 are tightly pressed and therefore, there is a good conductivity. As shown in FIG. 2 and FIG. 3, the cavities 13, 14 and 15 are formed on the bottom of the upper cover 10 and are provided for receiving the vertical walls 29E, 29F and the terminal 29A on the housing 30. There are also other cavities provided on the bottom of the upper cover 10 for holding of another vertical walls 29H and 29J as well as the terminal 29B, which are not shown in the drawing.

Figure 5:
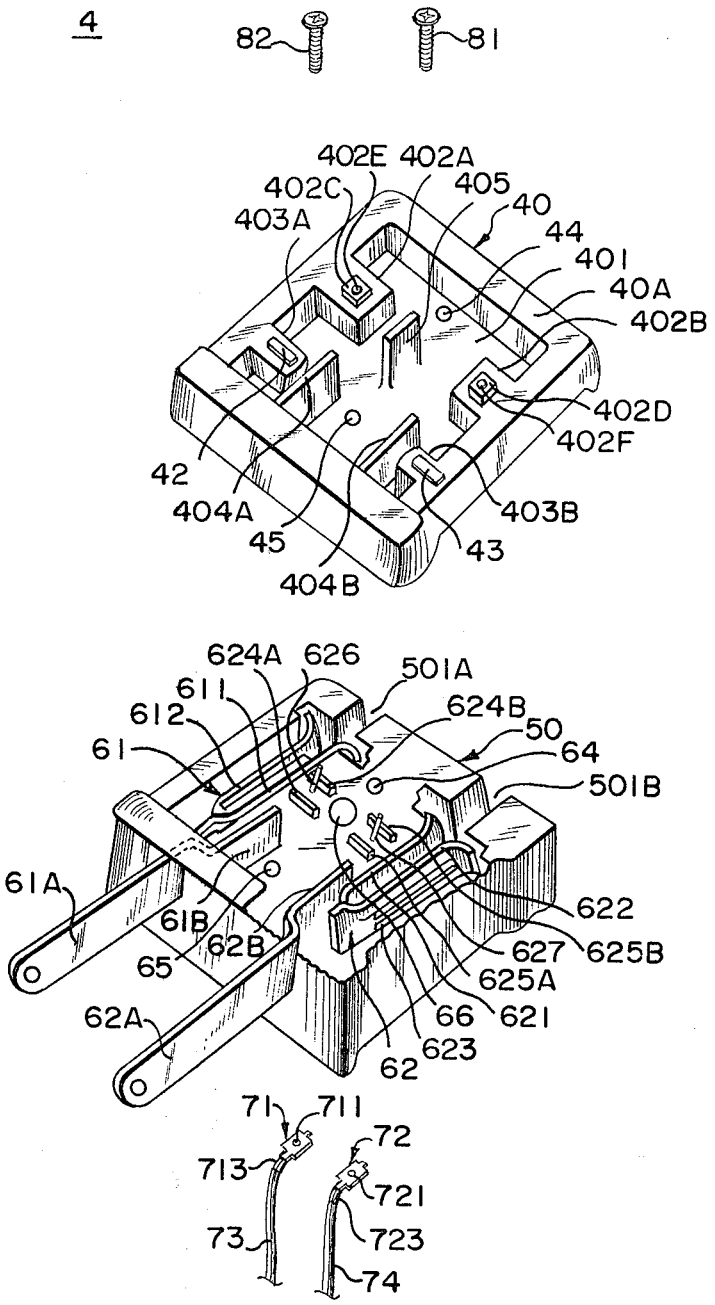
FIG. 5 is a perspective view of a second embodiment according to the invention, all elements being separate and positioned for the purpose of clearness.

FIG. 5 shows another embodiment of the invention. Besides some slight alternations, it is substantially the same as the first embodiment. The plug 4 is composed of an upper cover 40 and a housing 50, both of them are made of insulative material. The upper cover has a flat planar surface and its other surface 40A is formed with a cavity 401. A first pair of extending members 402A and 402B are part of the cover body 40 and the extensions thereof are appropriately spaced apart. On the extending members 402A and 402B, there are projected members 402C and 402D with openings 402E and 402F. A second pair of extending members 403A and 403B are also formed as part of the cover 40 and the extensions are also appropriately spaced apart within the cavity. Two thin fuse plates 42 and 43 are adhered on the surfaces of the members 403A and 403B, moreover, another vertical plate 405 is formed in one position of the cavity 401, the functions of these elements will be described below. The upper cover 40 in the drawing is placed up side down for the purpose of clearly illustrating the plug elements.

The housing 50 has two parallel slot openings 501A and 501B at the rear end thereof, and two receiving means 61 and 62 are placed in these slots. Two conductive plates 61A, 62A act as prongs for the housing 50. At the location where the plates 61A, 62A contact the housing body 50, they are bent in an s-like angle then extended into the housing 50 to form two inner portions 61B, 62B, thus the outer and inner portions 61A–61B and 62A–62B are integral and parallel to each other, in addition, a space is presented between the inner plate 61B (62B) and the receiving means 61 (62). The receiving means 61 and 62 are similar to the plates 34A and 34B in the first embodiment as mentioned above. In fact, it is an embodiment from which the flat portion 342 is deleted but the legs 341, 345, 346 and the end of 344 of the plate 34 as shown in FIG. 4 are retained. Therefore, each of the receiving means 61 (or 62) has the first leg 611 (or 621), the second leg 612 (or 622), and the third leg 623 (or 613, not shown). A hole 66 is defined at the housing 50 for leading terminals 71 and 72 connected with conductors 73 and 74 into the housing 60. The terminals 71 and 72 are of conventional structure and having two openings 711, 712. Two conductors 73, 74 are clamped by two crimping portions 713, 723 of the terminals 71, 72, after the terminals 71, 72 are introduced into the housings 50 through the opening 66, the openings 711 and 721 can be inserted by two stands 626 and 627 formed on the housings 50, and held by two pairs of insulating plates 624A–624B and 625A–625B formed on the both sides of the stands 626, 627. Finally, the terminals 71, 72 are connected to the first leg 611 and 621 of the receiving means 61 and 62 respectively. Whenever the conductors 73 and 74, which are exposed outside the plug, are subjected to external force, the terminals 71 and 72 will not be loosen due to the presence of the stands 626, 627 and the two pairs of insulative plates 624A–624B and 625A–625B.

After the upper cover 40 and the housing 60 are joined together by means of bolts 81 and 82 which pass through holes 44, 45, and 64, 65 of the upper cover 40 and housing 50, one end of the fuse 43 is connected to the surface of plates 61B, while the other end of the fuse 43 is connected to the surface of the first leg 611 of the plate 61. Similarly, two ends of the second fuse 42 are connected, respectively, to the plate 62B and the first leg 621 of the plate 62, the fuses 43 and 42 are thus interposed between the power source and the load as a protection. The circuit is as follows:

Power source→External plate 61A→Internal plate 61B→One end of the first fuse 43→The other end of the fuse 43→The first leg 611 of the plate 61→The conductive terminal 71→Conductor 73→Load.

Power source→External plate 62A→Internal plate 62B→One end of the second fuse 42→The other end of the fuse 42→The first leg 621 of the plate 62→The conductive terminal 72→Conductor 74→Load.

Simultaneously, the insulating plates 404A and 404B prevent movement of the plates 61B and 62B and thus, prevent from a short circuit due to the moving of plates 61B and 62B. Another insulating plate 405 ends at the center of hole 66 for separating the two wires 73 and 74 which are inserted into the housing in order to prevent a short circuit. Furthermore, the holes 402E of the projecting members 402C, 402D receive the two stands 626, 627, and the terminals 71, 72 are pressed tightly by the members 402C, 402D, so that the terminals 71, 72 are closely connected with the first leg 611 and 621 respectively.

While the present invention has been described with reference to the particular structure shown, it is not confined to the details herein disclosed, and this application is constructed as may come within the purposes of the invention or the scope of the following claims.

I claim:

1. A fused electric plug comprising a cover, a housing assembly and at least two fuse elements, said housing assembly having two elongate, unitary conductive plates, each plate including a planar portion extending out of said housing assembly and a U-like portion housed in said housing; said U-like portion including first and second leg elements extending longitudinally of said plate and joined at one end of each of said leg elements to one end of said planar portion, said first and second leg elements extending beside each other, and a third leg element which is joined at one end thereof to another end of said second leg element and which extends from said second leg element at an angle thereto; two conductive terminals each connected with a conductor and located adjacent one of said U-like portions, respectively; each of said fuse elements being interposed directly between one side of said U-like portion and one terminal respectively, said cover and said housing assembly being fixed together so that each of said fuse elements is in electrical contact with an associated U-like portion and terminal.

2. A plug as defined in claim 1 wherein said plate first and second legs are separated from each other.

3. A plug as defined in claim 2 wherein said first and second leg one ends are bent ends.

4. A plug as defined in claim 1 wherein one of said fuse elements includes two fine conductive wires, said fuse element further including a fuse filament and an insulative ball connecting said conductive wires together, said fuse elements each including a first end which has said two fine wires electrically separated from each other and a second end has said two fine wires electrically connected to said fuse filament to be connected together by said filament.

5. A plug as defined in claim 1 further including a vertical insulating plate interposed between each terminal and the plate U-like portion associated with said each terminal.

6. A fused plug comprising an upper cover and a housing, said upper cover including a planar surface and another surface which has a cavity defined therein, said cover further including two pairs of extending members located in said cavity, one end of each member being connected integrally to said cover, said extending members being electrically separated from each other; said cover further including two projections each mounted on one of said extending members and having a fastener receiving opening defined therein, said cover further including a plurality of insulating plates formed within said cavity, said cover further including a second pair of extending members located within said cavity and two fuses each being mounted on one of said second pair of extending members respectively; said plug further including two conductive receiving means mounted in said housing, two elongate prongs extending outside said housing and bent at a location where said prongs contact said housing before passing into said housing, projections mounted on said housing adjacent said receiving means and walls mounted on said housing adjacent said projections; a wire accommodating hole defined through said housing; conductors, terminals electrically connected with said conductors, with said conductors passing through said housing via said wire accommodating hole, said terminals being located between said walls, said conductors being electrically separated by one of said cover insulating plates; each terminal being electrically connected with one of said receiving means and each fuse electrically connecting one of said prongs with an associated receiving means when said cover is mounted on said housing.

7. A fused electric plug comprising:

a cover;

an elongate housing having two longitudinally extending through slots defined therein, and two wells defined in said housing;

an elongate metal plate mounted in each slot, each plate being unitary and having a first leg portion having one end thereof spaced from said housing, a second leg portion of said plate and a third leg portion of said plate, said second and third leg portions being connected together at one end of each leg portion which one end is located adjacent said first leg portion, said third leg portion being accommodated by one of said wells;

two terminals each being electrically connected to a line cord, each terminal being located adjacent one of said housing wells;

two fuse elements each located on said cover and each having an insulative ball, two conductive filaments fixed to said insulative ball to form first and second pairs of conductive portions outside said insulative ball, and a fuse filament electrically connecting said first pair of conductive portions together, two conductive portions of said second pair of conductive portions of each fuse element being electrically connected to a plate leg portion and to a corresponding terminal;

said cover being fixed to said housing in a manner which facilitates secure contact between said conductive portions, said leg portions and said terminals.

8. A metal plate as defined in claim 7 wherein said second and third leg portions are separated from each other.

9. A fused electric plug comprising:

a cover;

a housing having a pair of recesses formed therein to be parallel with each other and to have one end of each recess defined in a rear end of said housing;

two prongs each having a planar and a bent portion with said planar portions being located outside a front end of said housing and being parallel with each other and said bent portions being located inside said housing and being parallel with each other;

two chuck-like elongate receiving means mounted in said housing, said receiving means each including a body, a first leg portion on said body having a pressed out portion therein extending longitudinally of said receiving means and spaced from said body, said first leg portion having one end thereof connected to said body and another end thereof spaced from said body, second and third leg portions each having one end thereof integrally connected to said body;

two posts each mounted on said housing adjacent one leg portion of one of said chuck-like receiving means;

two insulative walls mounted on said housing adjacent each post;

two terminals each connected to a line cord and each attached to one of said posts and electrically connected to one leg portion of one of said receiving means; and two fuse means mounted on said cover, each of said fuse means electrically coupling a prong bent portion to a receiving means leg portion to form an electric path.

10. A fuse electric plug as defined in claim 6 or 7 in which said cover and said housing are fixed together by fasteners.

11. A fuse electric plug as defined in claim 6 or 7 in which said cover and said housing are fixed together by ultra-sonic welding.

* * * * *